US012601234B1

(12) United States Patent
Alharbi et al.

(10) Patent No.: US 12,601,234 B1
(45) Date of Patent: Apr. 14, 2026

(54) LASER MILLING AND INJECTION SYSTEM FOR WATER CONING REMEDIATION

(71) Applicant: SAUDI ARABIAN OIL COMPANY, Dhahran (SA)

(72) Inventors: Bader Alharbi, Dhahran (SA); Sameeh Batarseh, Dhahran (SA); Ayman Almohsin, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/025,721

(22) Filed: Jan. 16, 2025

(51) Int. Cl.
*E21B 29/02* (2006.01)
*E21B 43/32* (2006.01)

(52) U.S. Cl.
CPC ..... *E21B 29/02* (2013.01); *E21B 43/32* (2013.01)

(58) Field of Classification Search
CPC ..... E21B 7/14; E21B 7/15; E21B 29/02
See application file for complete search history.

(56) References Cited

U.S. PATENT DOCUMENTS 2,229,177 A 1/1941 Kennedy et al.
6,755,262 B2 6/2004 Parker
6,888,097 B2 * 5/2005 Batarseh ..... B23K 26/064 175/11
9,903,171 B2 2/2018 Linetskly
11,041,354 B2 6/2021 Pipchuk et al.
2009/0255671 A1 * 10/2009 Georgi ..... E21B 49/10 166/264
2014/0360778 A1 * 12/2014 Batarseh ..... E21B 7/15 175/17
2015/0107833 A1 4/2015 Boone et al.
2017/0191314 A1 * 7/2017 Faircloth ..... E21B 37/00
2018/0306017 A1 10/2018 Savage
2018/0362827 A1 * 12/2018 Bataweel ..... C09K 8/46
2025/0270890 A1 * 8/2025 Al Marhoon ..... E21B 29/06

FOREIGN PATENT DOCUMENTS

CN 104847302 A 8/2015
CN 106150466 A 11/2016

OTHER PUBLICATIONS

Rajan, Varagur S.V., and Richard W. Luhning. "Water Coning Suppression." J Can Pet Technol 32 (1993): No Pagination Specified.
Muskat, M., and R.D. Wycokoff. "An Approximate Theory of Water-coning in Oil Production." Trans. 114 (1935): 144-163.

* cited by examiner

*Primary Examiner* — David Carroll
(74) *Attorney, Agent, or Firm* — Vorys, Sater, Seymour and Pease LLP

(57) ABSTRACT

A laser milling and injection system operable to perform water shutoff operations in a wellbore includes a laser source, a source of a sealing gel mixture operable to cure into a bulk material, and a tool head insertable within the wellbore and operably coupled to the laser source and the source of the sealing gel mixture. The tool head includes a rotational control lens operable to receive a laser beam from laser source and tune the laser beam into an oblong shape directed towards a wall of the wellbore to generate an oblong tunnel extending laterally from the wellbore, and one or more fluid outlets operable to inject the sealing gel mixture into the laterally-extending tunnel.

20 Claims, 6 Drawing Sheets

LASER MILLING AND INJECTION SYSTEM FOR WATER CONING REMEDIATION

FIELD OF THE DISCLOSURE

The present disclosure relates generally to operations for the remediation of water coning in a hydrocarbon producing wellbore, and, more particularly, to systems and methods for performing water shutoff operations in vertical wellbores.

BACKGROUND OF THE DISCLOSURE

During hydrocarbon extraction operations, oil is often drawn into a vertical or slightly deviated wellbore from a surrounding oil-producing geological zone present at a specific depth. In some cases, the oil-producing zone may be positioned vertically above, or may rest upon, a water-producing zone deeper within the ground. As the oil is drawn out of the oil-producing zone and into the wellbore, a pressure differential may develop between the oil-producing zone and the water-producing zone. When the pressure differential reaches a critical value, water may be drawn vertically upward into the oil-producing zone and may enter the wellbore in a process known as "water coning". This introduction of additional water production within the wellbore can both reduce the volume of oil that can be extracted from the oil-producing zone and increase costs related to water handling and disposal.

Techniques have been developed for remediating water coning in vertical wellbores, which may include mechanical and chemical interventions within the wellbore. Common water shutoff procedures include the deployment of packers and cement within the wellbore to abandon a lower portion of the wellbore where water is penetrating. Further procedures include the use of sealants and polymers that are injected into the wellbore to fill porous networks in the geology that are producing water. In situations where the water coning may be deemed too extensive and expensive to remediate, sidetracking operations or well abandonment may be necessary. As the aforementioned remediation techniques can be expensive to deploy and maintain, the costs of water coning remediation may outweigh the benefits, and lead to increased instances of well abandonment.

As such, methods and systems for cost-effective water shutoff operations in vertical wellbores exhibiting water coning are desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a laser milling and injection system for performing water shutoff operations in a wellbore includes a laser source, a source of a sealing gel mixture operable to cure into a bulk material, and a tool head insertable within the wellbore and in communication with the laser source and the source of the sealing gel mixture. The tool head includes a rotational control lens operable to receive a laser beam from laser source and tune the laser beam into an oblong shape directed towards a wall of the wellbore and thereby generate an oblong tunnel extending through the wall and laterally from the wellbore, and one or more fluid outlets operable to inject the sealing gel mixture into the oblong tunnel.

In another embodiment, a method of performing water shutoff operations in a wellbore includes advancing a tool head into the wellbore to a location above an interface between an oil-producing zone and a water-producing zone, emitting a laser beam from the tool head to generate an elliptical tunnel extending laterally through a wall of the wellbore, rotating the tool head to aim the laser beam at a location adjacent to the elliptical tunnel, generating a plurality of overlapping elliptical tunnels to create a disk-shaped void within the wall of the wellbore, injecting a sealing gel mixture into the disk-shaped void, and curing the sealing gel mixture to form a bulk material that prohibits water production into the wellbore through the disk-shaped void.

In a further embodiment, a laser milling and injection tool head includes a tool housing sized to be received within a wellbore, a rotational control lens arranged within the tool housing and operable to tune a shape and size of a laser beam to generate one or more elliptical tunnels through a wall of the wellbore, and one or more fluid pipes with fluid outlets arranged within the tool housing and operable to emit a sealing gel mixture into the one or more elliptical tunnels to form a bulk material that prohibits water production across the elliptical tunnels and into the wellbore.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
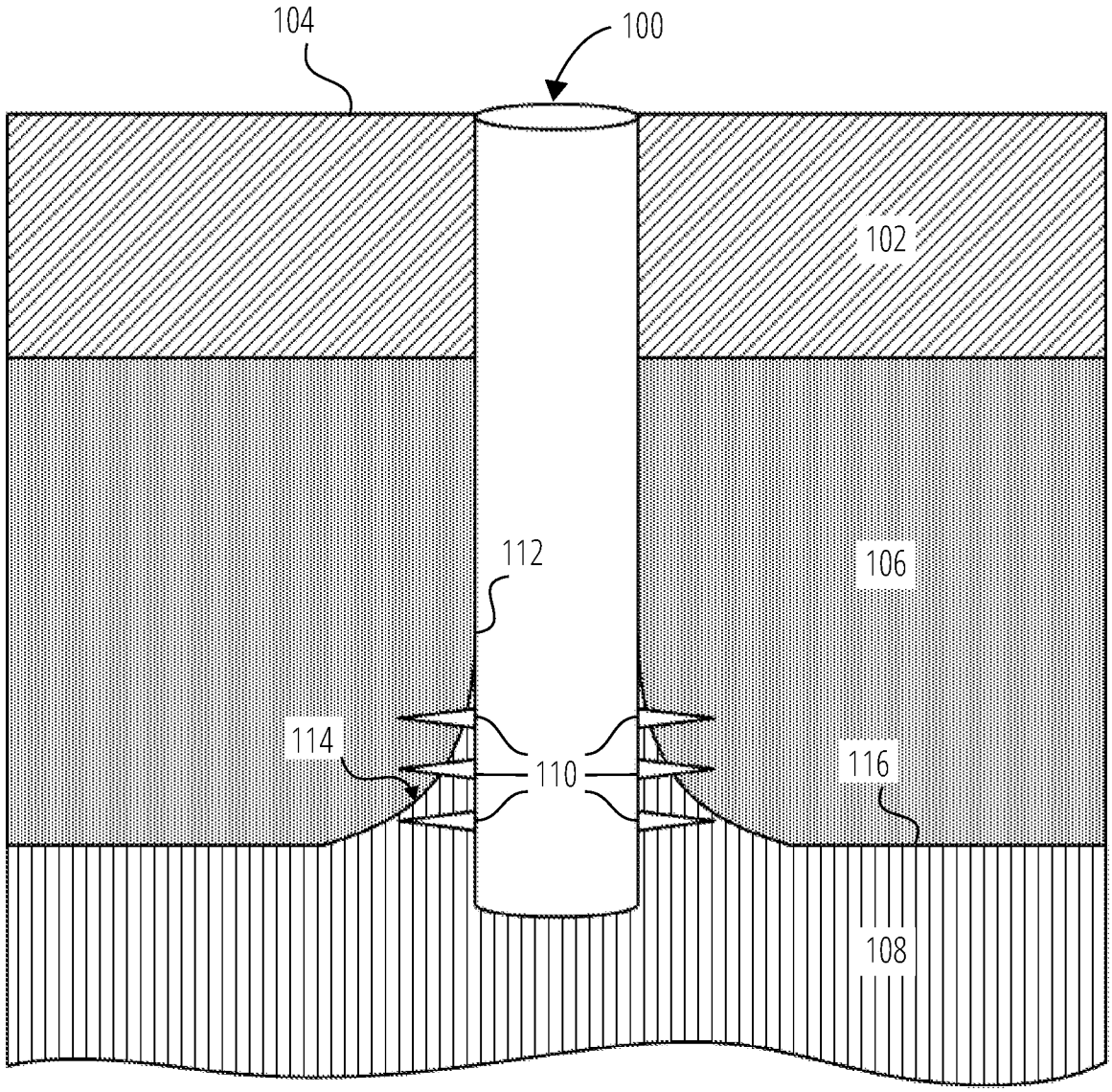
FIG. 1 is a schematic view of a vertical wellbore extending into an earthen formation in which water coning is occurring, according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to water coning remediation and, more particularly, to systems and methods for performing water shutoff operations in vertical wellbores. Embodiments disclosed herein include a laser milling and injection system operable to perform both laser milling and injection operations involved in water shutoff operations in vertical wellbores exhibiting water coning. The laser milling and injection system may include a laser milling and injection tool head operable to tune and emit a laser beam to generate elliptical tunnels within a wall of a wellbore. The laser milling and injection tool head may further rotate within the wellbore to generate overlapping elliptical tunnels that together form a disk-shaped void at or near an interface between an oil-producing zone and a water-producing zone. The systems and methods disclosed herein may facilitate the injection of a sealing gel mixture into the disk-shaped void via the same laser milling and injection tool head without tripping out of hole, thus saving time and operational costs. In some embodiments the sealing gel mixture may include a combination of a nanosilica, an activator, and a plurality of crushed date seeds. The sealing gel mixture may bond within the disk-shaped void to form a bulk material for blocking water production therethrough. As such, the disclosed embodiments provide unified systems and methods for performing both laser milling and injection operations within a vertical wellbore as part of water shutoff operations remediating water coning. The unified systems and methods may optimize the water shutoff operations and may utilize a low-cost sealing gel mixture to limit the operating expenses and downtime sustained in water shutoff operations.

FIG. 1 is a schematic view of a vertical wellbore 100 extending into an earthen formation 102 in which water coning is occurring, according to one or more embodiments of the present disclosure. The wellbore 100 may be seen to extend from a surface 104 into the earthen formation 102 to a depth in which the wellbore 100 may intersect at least a portion of an oil-producing zone 106. The oil-producing zone 106 may comprise at least a portion of a hydrocarbon reservoir identified within the earthen formation 102, and the wellbore 100 may be created for the purpose of extracting hydrocarbons from said hydrocarbon reservoir. In FIG. 1, it may be seen that the oil-producing zone 106 is positioned vertically above, or resting upon, a water-producing zone 108. The water-producing zone 108 may include porous cavities which are filled with, or provide flowpaths for, water.

The wellbore 100 may include a plurality of fractures 110 that are present within a wall 112 of the wellbore 100, thus enabling the flow of hydrocarbons from the oil-producing zone 106 into the wellbore 100. Over time, as the hydrocarbons enter the wellbore 100 from the oil-producing zone 106, a pressure differential may be created between the oil-producing zone 106 and the water-producing zone 108 below. As this pressure differential increases, water from the water-producing zone 108 may begin to be drawn up into the oil-producing zone 106 and around the cylindrical shape of the wellbore 100. As the water is pulled vertically upward by the pressure differential, a water cone 114 may form around the wellbore 100 and may intersect a location of the fractures 110. The presence of the water cone 114 at or near the fractures 110 may introduce water into the wellbore 100, thus leading to costly water treatment and removal during further hydrocarbon extraction operations conducted through the wellbore 100. As such, water shutoff operations may be beneficial at or near an interface 116 between the oil-producing zone 106 and water-producing zone 108, such that water production is limited within the wellbore 100 while enabling further hydrocarbon extraction from the oil producing zone 106.

Figure 2:
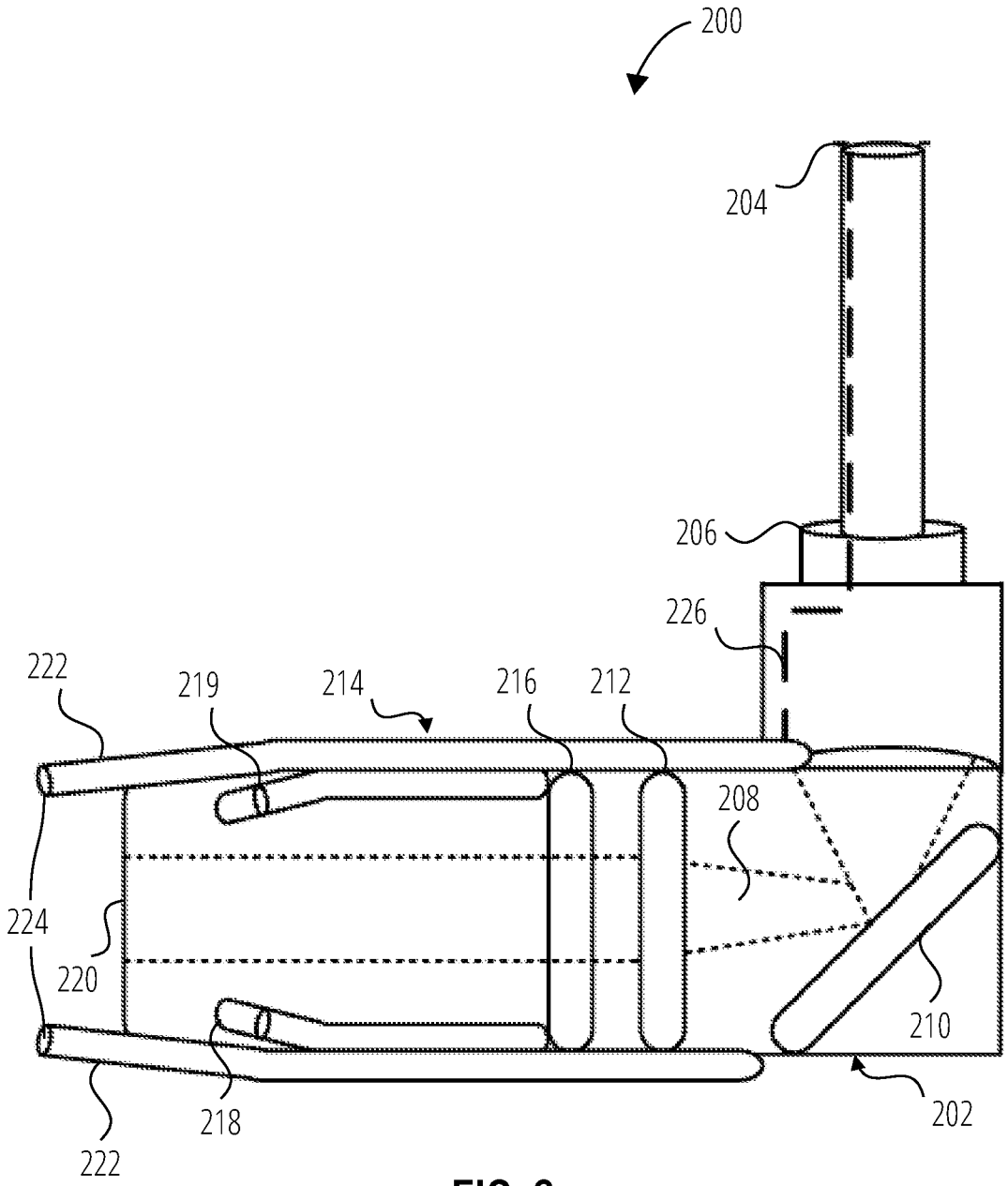
FIG. 2 is a schematic side view of a tool head for performing laser milling and injection in water shutoff operations, according to one or more embodiments of the present disclosure.

FIG. 2 is a schematic side view of an example laser milling and injection tool head 200 for performing laser milling and injection in water shutoff operations, according to one or more embodiments of the present disclosure. The laser milling and injection tool head 200 (hereinafter, "the tool head 200") may include a tool housing 202 sized to be received within the wellbore 100 of FIG. 1. The tool housing 202 may provide a main body of the tool head 200 in which further components may be included, supported and protected. The tool housing 202 may be couplable with a conveyance 204, shown here as a coiled tubing, for advancing, rotating and otherwise maneuvering the tool head 200 within the wellbore 100. The conveyance 204 may provide optical and fluid communication between the surface 104 of FIG. 1 and the tool head 200 during operations conducted in the wellbore 100. In some embodiments, the tool housing 202 and conveyance 204 may be interposed by a swivel mechanism 206. The swivel mechanism 206 may include a radial bearing or a ratcheting component, such that the swivel mechanism 206 may enable rotation of the tool head 200 with respect to the conveyance 204.

Figure 3:
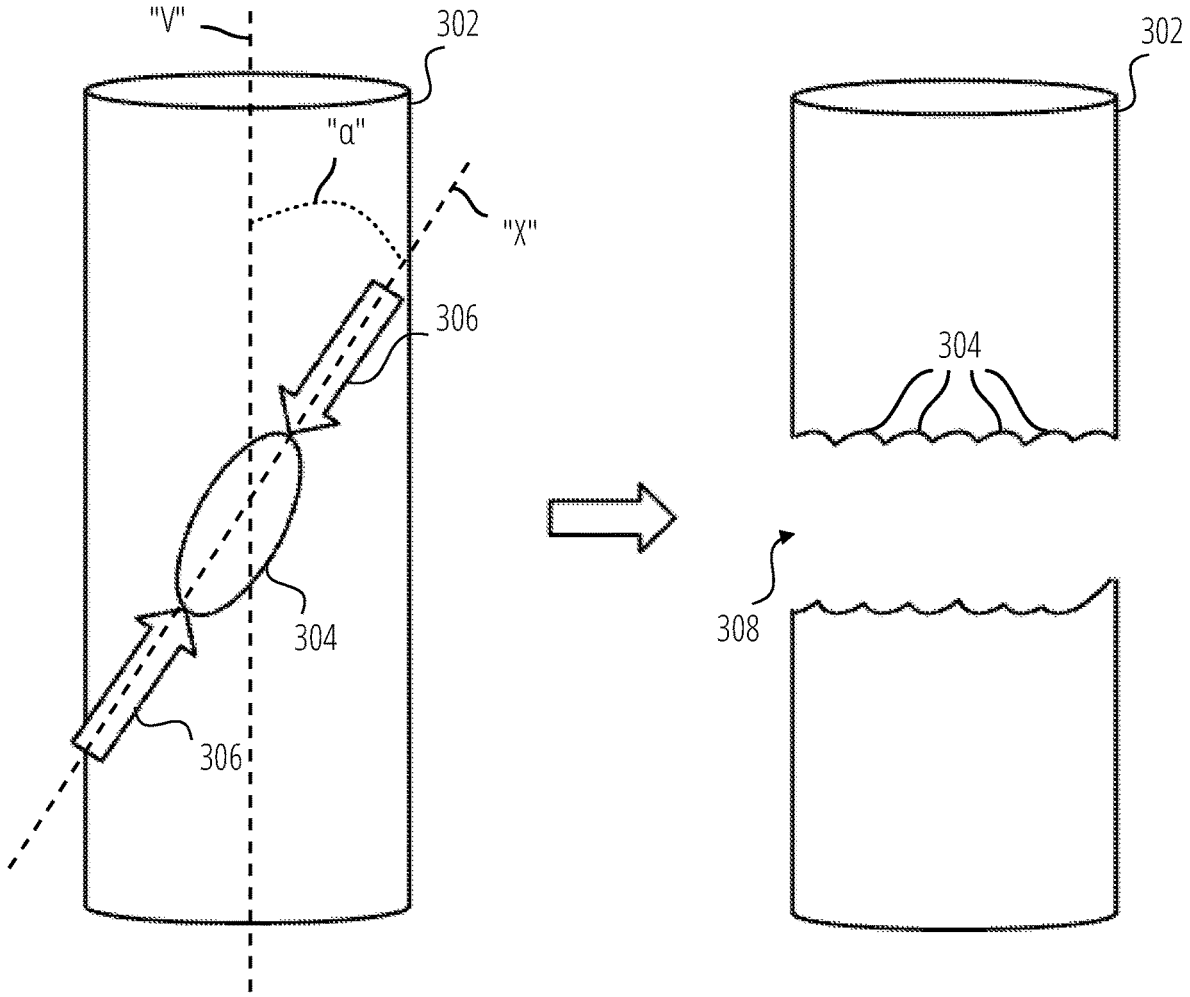
FIG. 3 is a schematic illustration of a process for the formation of a void within a core sample from a plurality of elliptical tunnels, which may each be milled by the tool head, according to one or more embodiments of the present disclosure.

The conveyance 204 may include fiber optics (not shown) through which a laser beam 208 may be transmitted from the surface 104 to be received within the tool housing 202. The laser beam 208 may be a high-powered laser operable to mill through the wall 112 of the wellbore 100 of FIG. 1 as described in greater detail below. The tool head 200 may include a reflector 210 positioned within the tool housing 202 and maintained at an angle to reflect the laser beam 208 from a vertical direction to a horizontal direction within the tool housing 202. The tool head 200 may further include a rotational control lens 212 within a horizontal section 214 of the tool housing 202. The rotational control lens 212 may be rotationally manipulable to tune the size and shape of the laser beam 208 therethrough. The rotational control lens 212 may accordingly enable the tuning of the laser beam 208 into an elliptical shape and/or at an angled orientation relative to vertical (as seen in FIG. 3). In some embodiments, the rotational control lens 212 may be tuned prior to operation and insertion within the wellbore 100 of FIG. 1. In further embodiments, however, the rotational control lens may be mountable to an actuatable bracket (not shown), which may be controlled via electrical or hydraulic actuation to tune the control lens 212 while deployed.

In some embodiments, the horizontal section 214 of the tool housing 202 may further include a cover lens 216. The cover lens 216 may be spaced from the rotational control lens 212 such that the laser beam 208 passes through the cover lens 216 after passing through the rotational control lens 212. The cover lens 216 may be installed within the horizontal section 214 to protect the rotational control lens 212 and other components of the tool head 200 from debris and wellbore fluids during operation of the tool head 200. Additionally, the tool head 200 may include one or more purging knives 218 within the horizontal section 214 of the tool housing 202. The purging knives 218 may be positioned between the cover lens 216 and an outlet 220 of the tool head 200. The purging knives 218 may include fluid channels within the tool housing 202 terminating in openings 219 aimed towards the path of the laser beam 208 within the horizontal section 214. The purging knives 218 may emit a purging fluid to pressurize the tool housing 202 during operation to thereby further prevent the entry of debris and wellbore fluids towards the cover lens 216 and rotational control lens 212. The purging fluid emitted from the openings 219 of purging knives 218 may further provide an optically-favorable environment for the laser beam 208 within the horizontal section 214 as the laser beam 208 exits through the tool head outlet 220 and towards a target. In some embodiments, the purging fluid may be nitrogen, water, halocarbon, or any optically-transparent fluid.

The tool housing 202 may further include one or more fluid pipes 222 extending along an outer surface of the horizontal section 214 of the tool housing 202. The fluid pipes 222 may each include a fluid outlet 224 aimed in the same direction as the laser beam 208 through the tool head outlet 220. The fluid pipes 222 may be in fluid communication with a source of a sealing gel mixture from the surface 104 of FIG. 1, as described in greater detail below. The fluid outlets 224 may be operable to inject the sealing gel mixture into any tunnels milled via the laser beam 208. In some embodiments, the fluid pipes 222 and the purging knives 218 may be in fluid communication with one or more internal fluid lines 226 coupled to the conveyance 204. As such, the internal fluid lines 226 may provide a pathway for the purging fluid to reach the purging knives 218 and the sealing gel mixture to reach the fluid pipes 222 within the tool housing 202.

FIG. 3 is a schematic illustration of a process for the formation of a void within a core sample 302 from a plurality of elliptical tunnels 304, which may each be milled by the tool head 200 of FIG. 2, according to one or more embodiments of the present disclosure. The core sample 302 defines a vertical axis "V" and may represent a composition of the rock found within the oil-producing zone 106 of FIG. 1, such that the core sample 302 may mimic the behavior of the wall 112 of the wellbore 100 of FIG. 1 in-situ. In a first embodiment, the core sample 302 may include an elliptical tunnel 304 milled therethrough via the tool head 200 of FIG. 2. The elliptical tunnel 304 may be seen to be elliptical in shape defining a major axis "X." The elliptical tunnel 304 may be positioned at an orientation relative to vertical to align the major axis "X" with a stress direction 306 identified in the cores sample 302. For example, the major axis "X" may be oriented horizontally, vertically or at an oblique angle "$\alpha$" from the vertical axis "V," depending on the orientation of the stress direction 306. The elliptical tunnel 304 may be milled in this shape and orientation to resist deformation and collapse. As such, the elliptical tunnel 304 may be seen to be parallel to stress directions 306 within the core sample 302, such that the elliptical tunnel 304 is resistant to deformation and collapse due to stress.

In a further embodiment, the core sample 302 can be seen with an extended void 308 defined therethrough. In this embodiment, the extended void 308 can be formed of a plurality of elliptical tunnels 304 at least partially overlapping through the core sample 302. The overlapping elliptical tunnels 304 may form the extended void 308 as the tool head 200 of FIG. 2 rotates, in which the fluid outlets 224 of FIG. 2 may inject the sealing gel mixture to form a bulk material. In other embodiments, the tunnels 304 may define alternate oblong shapes such as an oval, obround, irregular ellipse, etc. without departing from the scope of the disclosure.

Figure 4:
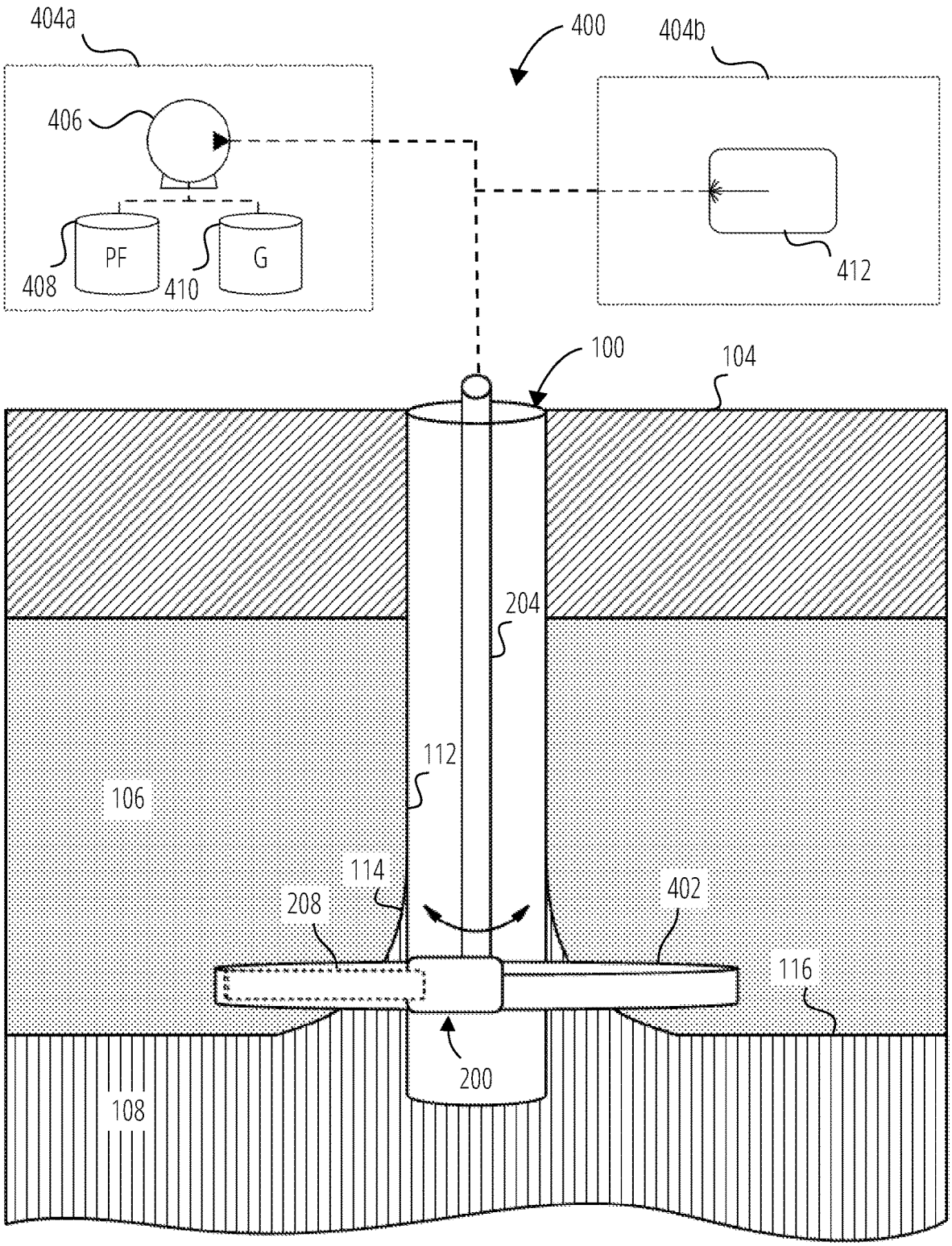
FIG. 4 is a schematic side view of a laser milling and injection system performing a laser milling operation within the wellbore, according to one or more embodiments of the present disclosure.

FIG. 4 is a schematic side view of a laser milling and injection system 400 performing laser milling operations within the wellbore 100, according to one or more embodiments of the present disclosure. The laser milling and injection system 400 (hereinafter, "the system 400") may include the tool head 200 inserted within the wellbore 100 via the conveyance 204, as well as further components included at surface locations 404*a*-404*b* residing at or near the surface 104.

At surface location 404*a*, the system 400 may include a fluid pump 406 operable to pump the purging fluid "PF" and/or the sealing gel mixture "G" through the conveyance 204 and into the tool head 200. In some embodiments, the fluid pump 406 may provide a sufficient pump rate to enable injection via the tool head 200 within the wellbore 100. The fluid pump 406 may be in fluid communication with a purging fluid tank 408 and a sealing gel mixture tank 410. The purging fluid tank 408 and sealing gel mixture tank 410 may provide storage for sufficient quantities of the purging fluid "PF" and sealing gel mixture "G", respectively, to perform water shutoff operations within the wellbore 100.

In some embodiments, the sealing gel mixture "G" may comprise a nanosilica, an activator, and a plurality of crushed date seeds, which may be cured to form a bulk material. In these embodiments, the nanosilica may be an organosilane-modified colloidal silica and the activator may be an accelerator, such as sodium silicate. In further embodiments, however, the sealing gel mixture "G" may include crosslinked polymer gels, pre-formed particle gels, cements, or other sealants. The crushed date seeds may be size-controlled to adjust to a fracture size and acts as a porous material for the binding of the nanosilica, such that the sealing gel mixture "G" may form a rigid material that may resist high pressures and seal water production.

At surface location 404*b*, the system 400 may include a laser source 412 in optical communication with the tool head 200 through the conveyance 204. The laser source 412 may be operable to provide a high-powered laser, in the form of laser beam 208, to the tool head 200 to be used in laser milling the wall 112 of the wellbore 100. In some embodiments, the surface locations 404*a*-404*b* may be the same location, such that the fluid pump 406, purging fluid tank 408, sealing gel mixture tank 410, and laser source 412 are present in the same location.

In the illustrated embodiment, the laser beam 208 has been emitted from the tool head 200 to generate a disk-shaped void 402. The disk-shaped void 402 may be milled by the laser beam 208 as a plurality of elliptical tunnels 304 (FIG. 3) formed in the wall 112 of the wellbore 100 near the interface 116 between the oil-producing zone 106 and the water-producing zone 108. The plurality of elliptical tunnels may be generated as the tool head 200 rotates via the swivel mechanism 206 of FIG. 2, such that overlapping elliptical tunnels may form the disk-shaped void 402 within the oil-producing zone 106 and extending laterally from the wellbore 100. The disk-shaped void 402 may be positioned at or above the interface 116 between the oil-producing zone 106 and the water-producing zone 108, such that the disk-shaped void 402 may divide the oil-producing zone 106 near the location of the water cone 114.

Figure 5:
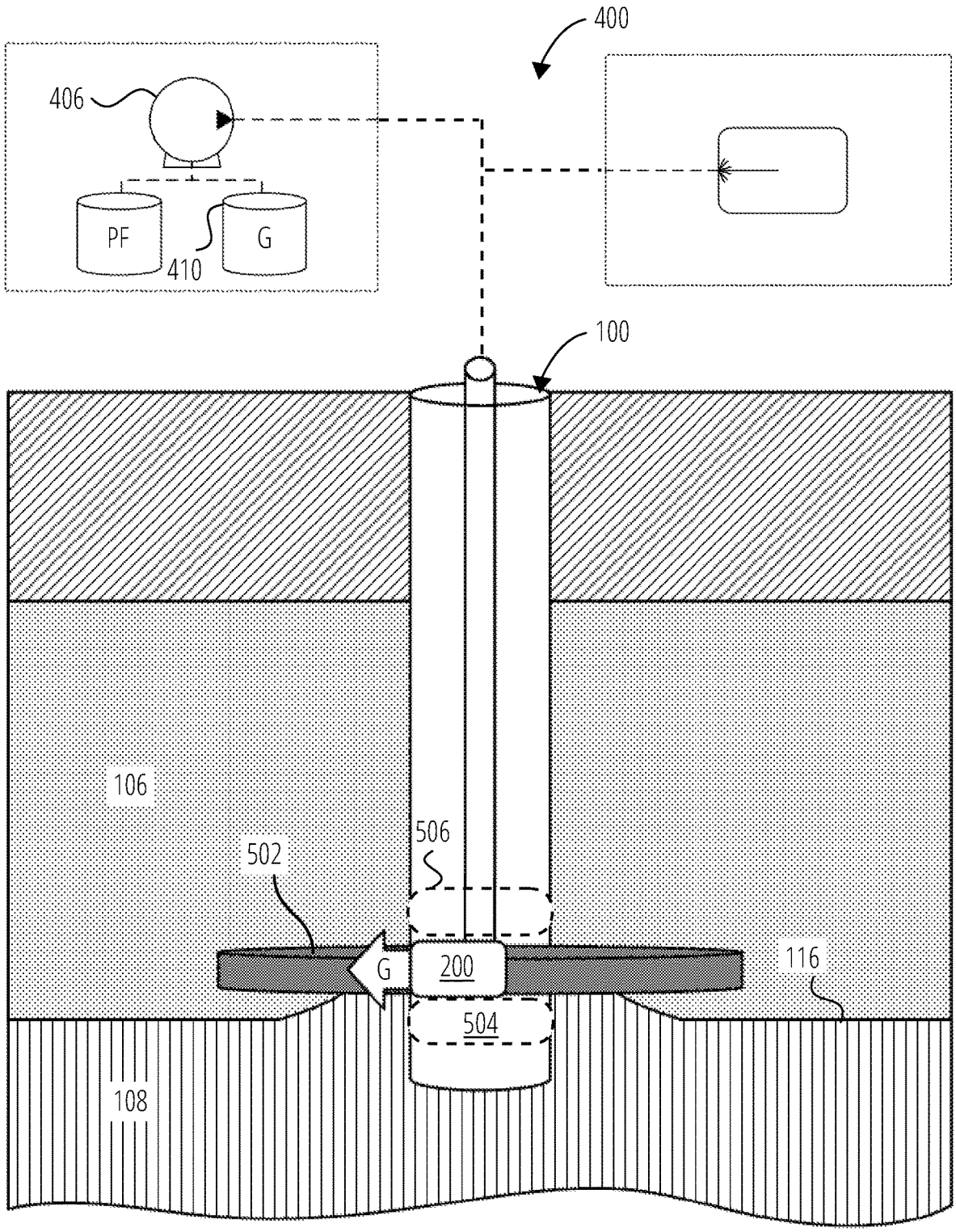
FIG. 5 is a schematic side view of the laser milling and injection system performing an injection operation within the laser-milled wellbore, according to one or more embodiments of the present disclosure.

FIG. 5 is a schematic side view of the laser milling and injection system 400 performing an injection operation within the laser-milled wellbore 100, according to one or more embodiments of the present disclosure. As discussed above, the tool head 200 may generate a laser-milled disk-shaped void 402 (FIG. 4) laterally extending from the wellbore 100 to divide the oil-producing zone 106 at or above the water cone 114 of FIGS. 1 and 4. The tool head 200 may further receive the sealing gel mixture "G" from the sealing gel mixture tank 410 and fluid pump 406, which may be injected into the disk-shaped void 402 of FIG. 4. The scaling gel mixture "G" may bond within the disk-shaped void 402 of FIG. 4 to form the bulk material shown in sealing gel-filled void 502. In some embodiments, the system 400 may further include a plug, packer or sealing member 504 installed within the wellbore 100 below the interface 116 to prevent the sealing gel mixture "G" from flowing below the sealing member. In further embodiments, the system 400 may further include an inflatable cement retainer 506 installed above the sealing gel-filled void 502 to prevent flow of the sealing gel mixture vertically upward within the wellbore 100. In these embodiments, the packer 504 and inflatable cement retainer 506 may be run within the wellbore 100 on the tool head 200 to enable water shut-off with a single trip. As such, the sealing gel mixture "G" may be limited to injection within the sealing gel-filled void 502 without contaminating or scaling any other portions of the wellbore 100.

As the bulk material of the sealing gel-filled void 502 forms, the bulk material may provide an impermeable barrier that prevents the water of the water-producing zone 108 from penetrating into the oil-producing zone 106 near the wellbore 100. As such, the water shutoff operation performed via the injection of the sealing gel mixture and the formation of the bulk material of the sealing gel-filled void 502 may remediate water coning within the wellbore 100. The system 400 may accordingly enable water shutoff operations including both laser milling and injection without tripping the tool head 200 out of hole, and may utilize cost-effective crushed date seeds, nanosilica, and an activator to form a water blocking bulk material.

Figure 6:
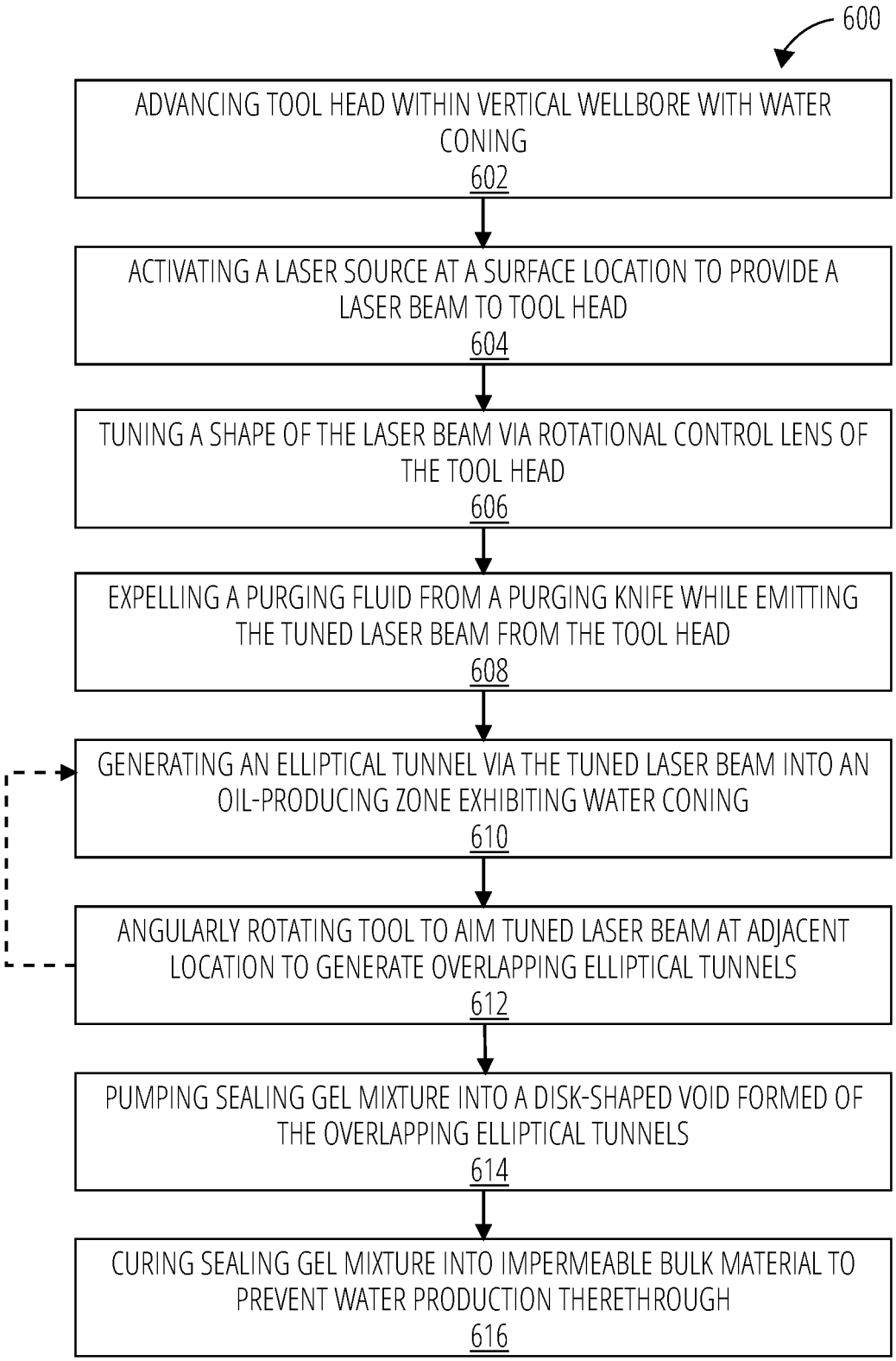
FIG. 6 is a schematic flowchart of an example method for performing water shutoff in a vertical wellbore to prevent water coning, according to one or more embodiments of the present disclosure.

FIG. 6 is a schematic flowchart of an example method 600 for performing water shutoff in a vertical wellbore to prevent water coning, according to one or more embodiments of the present disclosure. Although the example method 600 depicts a particular sequence of operations, the sequence may be altered without departing from the scope of the present disclosure. Some of the operations depicted may be performed in parallel or in a different sequence that does not materially affect the function of the method 600. In some embodiments, different components of an example device or system that implements the method 600 may perform functions at substantially the same time or in a specific sequence. The method 600 can be implemented by the laser milling and injection system 400, as shown in FIG. 4-5. Thus, reference can be made to the example of FIGS. 2-5 in the example of FIG. 6.

The method 600 may begin at 602 with advancing a laser milling and injection tool head (e.g., the tool head 200) within a vertical wellbore (e.g., the wellbore 100) exhibiting water coning at 602. The tool head may be advanced within the wellbore to reach a location at or near an interface (e.g., the interface 116) between an oil-producing zone (e.g., the oil-producing zone 106) and a water-producing zone (e.g., the water-producing zone 108), in order to perform water shutoff operations to remediate the effects of a water cone (e.g., the water cone 114) forming near the wellbore.

The method 600 may continue at 604 with activating a laser source (e.g., the laser source 412) at an external surface location (e.g., the surface location 404*b*) to provide a laser beam (e.g., the laser beam 208) to the tool head. The laser source may provide a high-powered laser to the tool head in order to perform laser milling of a wall (e.g., the wall 112) of the wellbore. The method 600 may further include tuning a shape of the laser beam at 606 via a rotational control lens (e.g., the rotational control lens 212) included within the tool head. The rotational control lens may enable the tuning of the laser beam to be elliptically-shaped, and may further enable orientation of the laser beam such that the elliptical shape of the laser beam aligns with stress directions (e.g., the stress directions 306) of the oil-producing zone to prevent deformation or collapse during laser milling.

The method 600 may continue at 608 with expelling a purging fluid (e.g., the purging fluid "PF") from a purging knife (e.g., the purging knife 218) while emitting the tuned laser beam from the tool head. The purging fluid and purging knife may provide an optically-favorable environment through which the laser beam may travel towards a wall of the wellbore at 608. The tuned laser beam may accordingly travel through the tool head and out through a tool head outlet (e.g., the tool head outlet 220) aimed towards the wall of the wellbore. The method 600 may continue at 610 with generating an elliptical tunnel (e.g., the elliptical tunnel 304) via the tuned laser beam into the oil-producing zone. The high-powered laser comprising the tuned laser beam may mill out the elliptical tunnel laterally through the oil-producing zone.

The method 600 may further include angularly rotating the tool head to aim the tuned laser beam at adjacent location, thus generating overlapping elliptical tunnels at 612. The tool head may be angularly rotated via a swivel mechanism (e.g., the swivel mechanism 206) to aim the tool head towards the adjacent location, or by rotating a conveyance (e.g., the conveyance 204) from a surface location (e.g., surface "S"). The method 600 may continue at 610 to generate a further elliptical tunnel overlapping the first, such that an extended void (e.g., the extended void 308) is formed within the wall of the wellbore. The method 600 may cyclically continue between generating an elliptical tunnel at 610 and angularly rotating the tool head at 612 until the tool head makes at least one full revolution within the wellbore. This cyclical performance of the method 600 may accordingly generate a disk-shaped void (e.g., the disk-shaped void) at or above the interface between the oil-producing zone and the water-producing zone.

The method 600 may continue at 614 with pumping a sealing gel mixture (e.g., the sealing gel mixture "G") into the disk-shaped void formed of the overlapping elliptical tunnels. The sealing gel mixture may be pumped to the tool head through actuating a fluid pump (e.g., the fluid pump 406) and may be injected into the disk-shaped void via fluid pipes (e.g., fluid pipe 222) and fluid outlets (e.g., fluid outlets 224) on the tool head. In some embodiments, the sealing gel mixture may comprise a nanosilica, an activator, and a plurality of crushed date seeds. The method 600 may accordingly continue at 616 with curing the sealing gel mixture into an impermeable bulk material within the sealing gel-filled void (e.g., the sealing gel-filled void 502), thus preventing water production across the bulk material. The sealing gel mixture may be cost-effective through the use of a combined colloidal silica and date seed mixture, which may be pumped downhole as a single fluid and cured within the scaling gel-filled void to form this impermeable bulk material. The method 600 can accordingly utilize a single tool head within a laser milling and injection system (e.g., the system 400) to perform both the laser milling and the injection of the sealing gel mixture without tripping out of hole or employing additional downhole tooling.

Embodiments disclosed herein include:

A. A laser milling and injection system for performing water shutoff operations in a wellbore, the system comprising a laser source, a source of a sealing gel mixture operable to cure into a bulk material, and a tool head insertable within the wellbore and in communication with the laser source and the source of the sealing gel mixture, the tool head including a rotational control lens operable to receive a laser beam from laser source and tune the laser beam into an oblong shape directed towards a wall of the wellbore and thereby generate an oblong tunnel extending through the wall and laterally from the wellbore, and one or more fluid outlets operable to inject the sealing gel mixture into the oblong tunnel.

B. A method of performing water shutoff operations in a wellbore, the method comprising advancing a tool head into the wellbore to a location above an interface between an oil-producing zone and a water-producing zone, emitting a laser beam from the tool head to generate an elliptical tunnel extending laterally through a wall of the wellbore, rotating the tool head to aim the laser beam at a location angularly adjacent to the elliptical tunnel, generating a plurality of overlapping elliptical tunnels to create a disk-shaped void within the wall of the wellbore, injecting a sealing gel mixture into the disk-shaped void, and curing the sealing gel mixture to form a bulk material that prohibits water production into the wellbore through the disk-shaped void.

C. A laser milling and injection tool head, the tool head comprising a tool housing sized to be received within a wellbore, a rotational control lens arranged within the tool housing and operable to tune a shape and size of a laser beam to generate one or more elliptical tunnels through a wall of the wellbore, and one or more fluid pipes with fluid outlets arranged within the tool housing and operable to emit a sealing gel mixture into the one or more elliptical tunnels to form a bulk material that prohibits water production across the elliptical tunnels and into the wellbore.

Each of embodiments A through C may have one or more of the following additional elements in any combination: Element 1: further comprising coiled tubing operably couplable the tool head to convey the tool head into the wellbore, the coiled tubing also facilitating fluid and optical coupling between the tool head and the laser source and the source of the sealing gel mixture. Element 2: wherein the sealing gel mixture comprises a nanosilica, an activator, and crushed date seeds to form the bulk material following injection into the oblong tunnel. Element 3: wherein the tool head further includes a swivel mechanism operable to provide angular rotation of the tool head within the wellbore. Element 4: wherein the swivel mechanism and the tool head are operable to generate a disk-shaped void in the wall of the wellbore formed of a plurality of overlapping, laterally-extending tunnels. Element 5: wherein the tool head further comprises a reflector operable to redirect the laser beam from the laser source and towards the rotational control lens. Element 6: wherein the oblong tunnel generated comprises an elliptical tunnel. Element 7: wherein the tool head further includes a purging knife positioned near an outlet of the tool head and operable to prevent a flow of wellbore fluids into the tool head using a purging fluid. Element 8: further comprising a purging fluid source in fluid communication with the tool head and the purging knife. Element 9: wherein generating the plurality of overlapping elliptical tunnels includes tuning, via a rotational control lens of the tool head, the laser beam to generate an elliptically-shaped laser beam.

Element 10: further comprising emitting, via a purging knife of the tool head, a purging fluid to prevent wellbore fluids from entering the tool head. Element 11: further comprising activating a laser source at a surface location to provide the laser beam to the tool head within the wellbore. Element 12: wherein the laser beam and the sealing gel mixture are provided to the tool head via coiled tubing connecting the surface location to the tool head. Element 13: further comprising actuating a fluid pump at the surface location to provide the sealing gel mixture to the tool head via the coiled tubing. Element 14: wherein the scaling gel mixture comprises a nanosilica, an activator, and a plurality of crushed date seeds to form the bulk material. Element 15: further comprising a purging knife positioned near an outlet of the tool head and operable to prevent a flow of wellbore fluids into the tool head. Element 16: wherein the sealing gel mixture comprises a nanosilica, an activator, and crushed date seeds to form the bulk material. Element 17: further comprising a conveyance matable with the tool housing and operable to advance the tool head within the wellbore.

By way of non-limiting example, exemplary combinations applicable to A through C include: Element 3 with Element 4; Element 7 with Element 8; Element 11 with Element 12; Element 12 with Element 13; Element 15 with Element 16; and Element 15 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A laser milling and injection system for performing water shutoff operations in a wellbore, the system comprising:

a laser source;

a source of a sealing gel mixture operable to cure into a bulk material; and a tool head insertable within the wellbore and in communication with the laser source and the source of the sealing gel mixture, the tool head including:

a rotational control lens operable to receive a laser beam from the laser source and tune the laser beam into an oblong shape directed towards a wall of the wellbore and thereby generate an oblong tunnel extending through the wall and laterally from the wellbore; and one or more fluid outlets operable to inject the sealing gel mixture into the oblong tunnel.

2. The laser milling and injection system of claim 1, further comprising coiled tubing operatively couplable to the tool head to convey the tool head into the wellbore, the coiled tubing also facilitating fluid and optical coupling between the tool head and the laser source and the source of the sealing gel mixture.

3. The laser milling and injection system of claim 1, wherein the sealing gel mixture comprises a nanosilica, an activator, and crushed date seeds to form the bulk material following injection into the oblong tunnel.

4. The laser milling and injection system of claim 1, wherein the tool head further includes a swivel mechanism operable to provide angular rotation of the tool head within the wellbore.

5. The laser milling and injection system of claim 4, wherein the swivel mechanism and the tool head are operable to generate a disk-shaped void in the wall of the wellbore formed of a plurality of overlapping, laterally-extending tunnels.

6. The laser milling and injection system of claim 1, wherein the tool head further comprises a reflector operable to redirect the laser beam from the laser source and towards the rotational control lens.

7. The laser milling and injection system of claim 1, wherein the oblong tunnel generated comprises an elliptical tunnel.

8. The laser milling and injection system of claim 1, wherein the tool head further includes a purging knife positioned near an outlet of the tool head and operable to prevent a flow of wellbore fluids into the tool head using a purging fluid.

9. The laser milling and injection system of claim 8, further comprising a purging fluid source in fluid communication with the tool head and the purging knife.

10. A method of performing water shutoff operations in a wellbore, the method comprising:

advancing a tool head into the wellbore to a location above an interface between an oil-producing zone and a water-producing zone;

emitting a laser beam from the tool head to generate an elliptical tunnel extending laterally through a wall of the wellbore;

rotating the tool head to aim the laser beam at a location angularly adjacent to the elliptical tunnel;

generating a plurality of overlapping elliptical tunnels to create a disk-shaped void within the wall of the wellbore;

injecting a sealing gel mixture into the disk-shaped void; and curing the sealing gel mixture to form a bulk material that prohibits water production into the wellbore through the disk-shaped void.

11. The method of claim 10, wherein generating the plurality of overlapping elliptical tunnels includes tuning, via a rotational control lens of the tool head, the laser beam to generate an elliptically-shaped laser beam.

12. The method of claim 10, further comprising emitting, via a purging knife of the tool head, a purging fluid to prevent wellbore fluids from entering the tool head.

13. The method of claim 10, further comprising activating a laser source at a surface location to provide the laser beam to the tool head within the wellbore.

14. The method of claim 13, wherein the laser beam and the sealing gel mixture are provided to the tool head via coiled tubing connecting the surface location to the tool head.

15. The method of claim 14, further comprising actuating a fluid pump at the surface location to provide the sealing gel mixture to the tool head via the coiled tubing.

16. The method of claim 10, wherein the sealing gel mixture comprises a nanosilica, an activator, and a plurality of crushed date seeds to form the bulk material.

17. A laser milling and injection tool head, comprising:

a tool housing sized to be received within a wellbore;

a rotational control lens arranged within the tool housing and operable to tune a shape and size of a laser beam emitted from the tool housing to generate one or more elliptical tunnels through a wall of the wellbore; and one or more fluid pipes with fluid outlets arranged within the tool housing and operable to emit a sealing gel mixture into the one or more elliptical tunnels to form a bulk material that prohibits water production across the elliptical tunnels and into the wellbore.

18. The laser milling and injection tool head of claim 17, further comprising a purging knife positioned near an outlet of the tool head and operable to prevent a flow of wellbore fluids into the tool head.

19. The laser milling and injection tool head of claim 18, wherein the scaling gel mixture comprises a nanosilica, an activator, and crushed date seeds to form the bulk material.

20. The laser milling and injection tool head of claim 18, further comprising a conveyance matable with the tool housing and operable to advance the tool head within the wellbore.

* * * * *